US007637773B2

(12) United States Patent
Shifris et al.

(10) Patent No.: US 7,637,773 B2
(45) Date of Patent: Dec. 29, 2009

(54) PATCH PANEL WITH A VARIABLE ANGLE

(75) Inventors: Pinchas Shifris, Tel Aviv (IL); Yaakov Haggay, Kfar Saba (IL); Uriya Mantver, Tel-Aviv (IL); Ilan Kelmer, Rehovot (IL)

(73) Assignee: RIT Technologies Ltd., Tel-Aviv (IL)

( * ) Notice: Subject to any disclaimer, the term of this patent is extended or adjusted under 35 U.S.C. 154(b) by 0 days.

(21) Appl. No.: 12/019,039

(22) Filed: Jan. 24, 2008

(65) Prior Publication Data

US 2008/0176445 A1 Jul. 24, 2008

Related U.S. Application Data

(60) Provisional application No. 60/897,049, filed on Jan. 24, 2007.

(51) Int. Cl.
*H01R 13/66* (2006.01)
*H01R 9/22* (2006.01)

(52) U.S. Cl. ..... 439/540.1; 439/719

(58) Field of Classification Search ..... 439/540.1, 439/467

See application file for complete search history.

(56) References Cited

U.S. PATENT DOCUMENTS

| | | | | |
|---|---|---|---|---|
| 5,765,698 | A * | 6/1998 | Bullivant | 211/26 |
| 5,788,087 | A * | 8/1998 | Orlando | 211/26 |
| 6,504,986 | B1 * | 1/2003 | Wambeke et al. | 385/134 |
| 6,866,541 | B2 | 3/2005 | Barker et al. | |
| 6,971,909 | B2 | 12/2005 | Levesque et al. | |
| 7,094,095 | B1 * | 8/2006 | Caveney | 439/540.1 |
| 2006/0118321 | A1 * | 6/2006 | Herring et al. | 174/101 |
| 2006/0291144 | A1 * | 12/2006 | Verding | 361/600 |
| 2008/0023212 | A1 * | 1/2008 | Larsen et al. | 174/101 |

* cited by examiner

*Primary Examiner*—Briggitte R Hammond
(74) *Attorney, Agent, or Firm*—Pearl Cohen Zedek Latzer, LLP

(57) ABSTRACT

Embodiments of the present invention are directed to an angled patch panel with a variable angle, the patch panel may be mounted on a communication rack and may have first and second patch panel elements connected by a hinge to enable angular movement of the patch panel elements relative to each other.

15 Claims, 2 Drawing Sheets

PATCH PANEL WITH A VARIABLE ANGLE

CROSS REFERENCE TO RELATED APPLICATIONS

The present invention claims benefit of U.S. provisional application No. 60/897,049, filed Jan. 24, 2007, entitled "Angled panel with hinge", the subject matter of which is incorporated herein by reference.

BACKGROUND OF THE INVENTION

Patch panels are well known in the data communication field. Patch panels may provide a plurality of communication ports incorporated into a single element that may connect incoming and outgoing lines of a communication system. For example, a patch panel may connect between active data equipment such as data switch or PBX and network devices such as personal computers. Usually, several patch panels are mounted onto a communication rack. Each patch panel may be connected with both patch cords at the front side of the patch panel and horizontal cables terminated on the rear side of each port.

A dense environment of cables is generally created on both front and rear sides of the patch panel. Such dense cable environment is difficult to manage, especially when both horizontal and vertical cable management within the communication rack is required. An improvement in the cable management of patch panels is highly required.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features and advantages thereof, may best be understood by reference to the following detailed description when read with the accompanied drawings in which:

Figure 1:
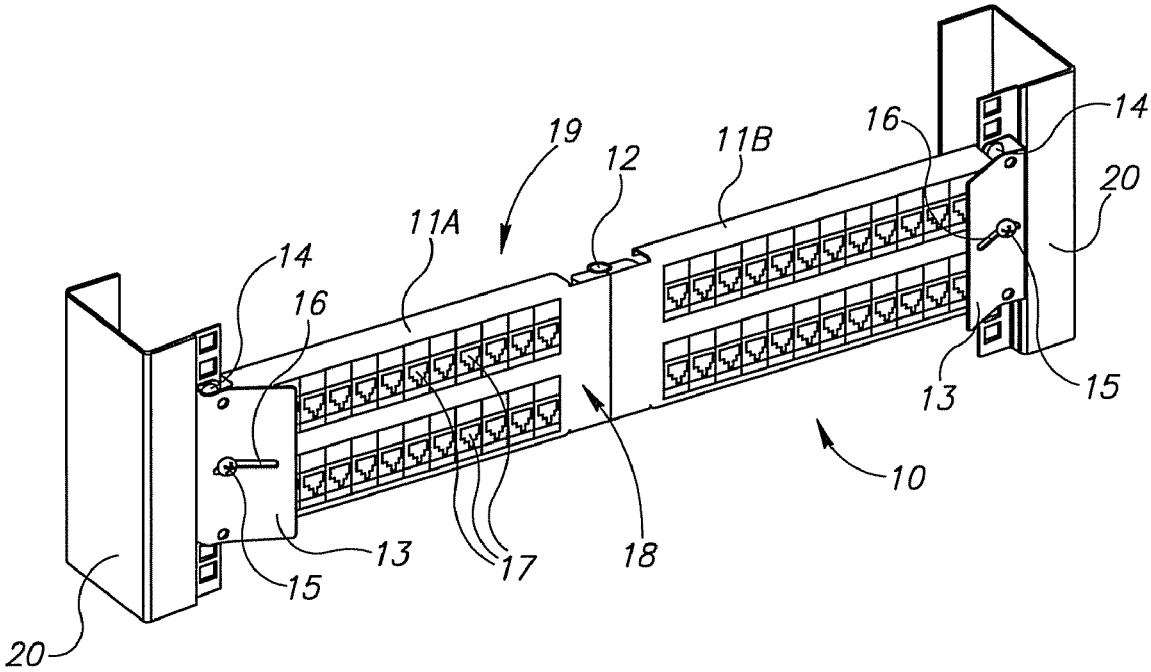
FIG. 1 is a front view of an angled patch panel in a flat position according to embodiments of the present invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF EMBODIMENTS OF THE INVENTION

In the following detailed description, numerous specific details are set forth in order to provide a thorough understanding of the invention. However it will be understood by those of ordinary skill in the art that the embodiments of present invention may be practiced without these specific details. In other instances, well-known methods, procedures and components have not been described in detail so as not to obscure the present invention.

Patch panel and network equipment rack systems may manage and organize cables to and from other network equipment and/or to and from other patch panels. Patch panel systems are generally intended to facilitate organization and management in implementing telecommunications wiring systems, e.g., for high speed data networks.

Embodiments of the present invention are directed to an angled patch panel with a variable front angle, the patch panel may be mounted on a communication rack and may have first and second patch panel elements connected by a hinge to enable angular movement of the patch panel elements relative to each other.

Figure 2:
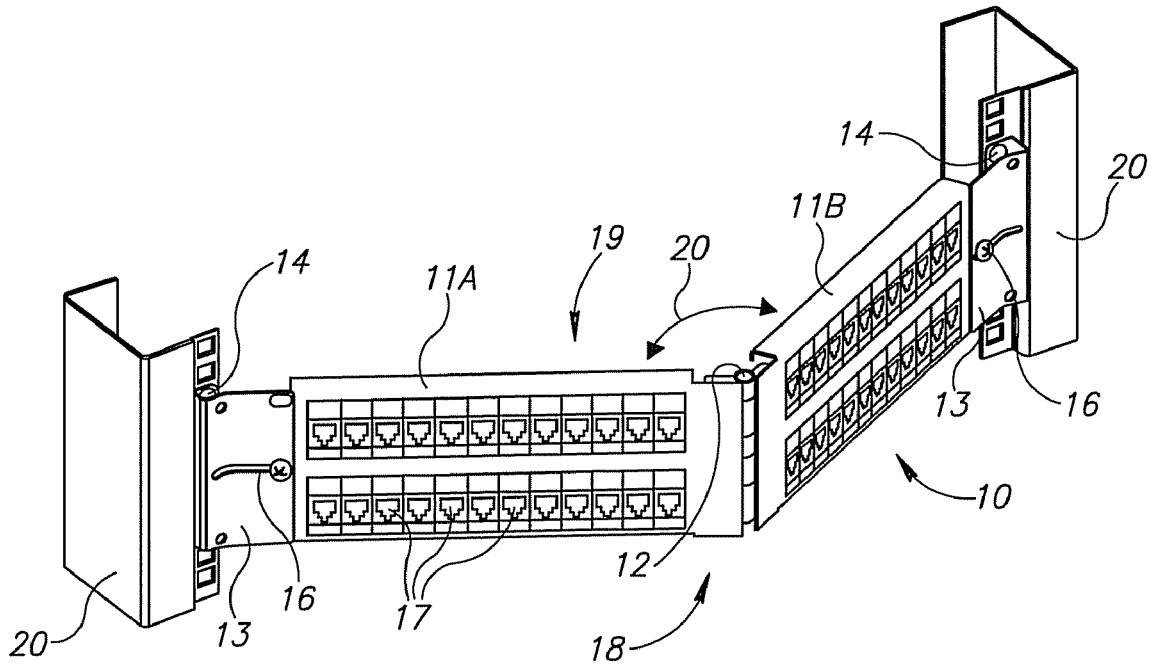
FIG. 2 is a front view of an angled patch panel in an angled position according to embodiments of the present invention.

Reference is now made to FIGS. 1 and 2. FIG. 1 is a front view of an angled patch panel in a flat position according to embodiments of the present invention and FIG. 2 is a front view of the angled patch panel in an angled position according to embodiments of the present invention. A patch panel 10 may be mounted between first and second communication rack elements 20 so as to enable wires or cables, e.g., unshielded twisted pair (UTP) cables, to be wired to connectors such as, insulation displacement connectors (IDC's), positioned at a rear side 19 of patch panel 10, and to enable patch cords to be plugged into jacks or communication ports 17 positioned in the front side 18 of patch panel 10. The use of patch cord may enable changing the connectivity along the communication paths easily and efficiently by plugging and unplugging the patch cords as needed.

Although embodiments of the present invention are not limited in this respect, patch panel 10 may provide the basic characteristics of a structured cabling system according to international standards for structured cabling systems such as standards of the American National Standards Institute (ANSI), Telecommunications Industry Association (TIA), Electronic Industries Alliance (EIA) and International Organization for Standardization (ISO)/International Electrotechnical Commission (IEC). For example, (ANSI)/(TIA)/(EIA)-568-B and (ISO/IEC) 11801. The patch panel may include any type of connectors such as RJ45 at any performance levels such as, for example category 5, 5e, 6 and higher, defined in these standards, fiber optics connectors, BNC connectors and others. The patch panel may be of a keystone type, where separate keystone modules are mounted into the panel, each may include an RJ45 jack and an IDC block.

The frame of patch panel 10 may be formed of a suitable material, such as metal. However, the frame may be formed of any suitable rigid material, such as plastic or composites. Patch panel 10 may be any size, for example it may be sized to fit within a conventional 19" or 23" EIA network rack. Patch panel may occupy a single rack unit height of 1.75" (4.45 cm) or multiple rack unit height, such as the two rack unit height (3.5" or 8.9 cm). The unit height, one standard Unit (1 U) is defined according to standard of the industry, such as the EIA RS 310-C Standard (November 1977). The patch panel may be a "high density" panel having two rows of ports within a rack space height of 1 U. The invention is not limited to such EIA racks, but is equally applicable to other known or subsequently developed racks. Rack systems including racks 20 and a plurality of patch panel 10 may serve as a telecommunications closet, allowing cables to be terminated, spliced, patched and/or stored at various places along their length.

Patch panel 10 may include two planar surfaces or elements 11A and 11B, which may be joined by an element that enables angular movement such as a hinge 12. Throughout the specification and the claims the term hinge is used to include any element or mechanism that enables angular movement of two elements with respect to each other.

Patch panel 10, may be mounted on or connected to communication rack 20 so as to substantially define a patching side on front side 18, where patch cords from another active device or another patch panel may be cross-connected and/or interconnected, and a distribution side on the rear side 19, where cables from network equipment and/or work station areas may be terminated. Wires or cables may be routed to a desired location at the rear side 19 of patch panel 10, i.e., in the bounded region defined by communication rack 20. Patch cords may be routed to a desired communication port 17 on the front side 18 of patch panel 10.

Although embodiments of the present invention are not limited in this respect, patch panel 10, may be mounted on or connected to communication rack elements 20 by any connecting mechanism or element. A demonstrative non-limiting example of connecting elements may include first and second brackets 13, each connected to opposite sides of rack 20 by using, for example, screws 14. Brackets 13 may be connected or mounted on opposite sides of rack 20 by using other connecting methods, such as using suitable adhesives, fasteners, snaps and the like. It should be understood to a person skilled in the art that any other connecting methods may be used to connect or mount patch panel 10 onto communication rack elements 20.

Each of the brackets 13 may be connected to a respective one of the first and second patch panel elements 11A and 11B by screws, hinges, pivots, other protrusions or any suitable element or mechanism that may compensate for the variation in the linear distance between the distal edges of the patch panel elements during angular movement of the elements relative to each other. For example each bracket 13 may include a slit 16 for connecting the bracket to a respective patch panel element. The patch panel element may be connected to the respective bracket by a screw 15 or any other suitable protrusion. Each screw 15 may be inserted into slit 16 so as to enable the angular movement of the patch panel elements 11A and 11B relative to each other when patch panel 10 is mounted on communication rack 20.

According to some embodiments of the invention, slits 16 may be used as a track to enable slidable movement of screws 15 extending from each one of the patch panel elements 11A and 11B when the patch panel elements angularly move relative to each other. The slidable movement of screws 15 and hinge 12 may enable positioning of the first and second patch panel elements 11A and 11B with respect to each other at an angle, referred inhere as angle 20 ranging between approximately 90° to 180°. The screws 15 may further be used to tighten the connection of brackets 13 to patch panel 10 when the desired angle is reached.

Surfaces 11A and 11B may be positioned at a flat angle of 180 degrees when the patch panel is at a position referred to herein as "flat mode" or "flat position". As shown in FIG. 1, at the flat surface position, the location of screws 15 in slits 16 are closest to rack 20. Screws 15 may be positioned at any location along slits 16. During angular movement of patch panel surfaces 11A and 11B around hinge 12, screws 15 may slide inwardly toward each other. FIG. 2 shows patch panel 10 at a position referred to as "angled mode" or an "angled position" when surfaces 11A and 11B may be positioned with respect to each other at obtuse angle of less than 180 degrees.

Although the present invention is not limited in this respect, a securing or locking element or mechanism (not shown) may be used to secure, fasten or lock surfaces 11A and 11B in flat position. Such an element may ensure that surfaces 11A and 11B are held together when having an angle of 180° between them and may prevent any movement or sliding of surfaces 11A and/or 11B.

Brackets 13 may have a bend or curved shape surface such that at least part of brackets 13 may be parallel to rack 20 to enable the attachment of brackets 13 to rack 20 by, for example, screws 14 and another portion of brackets 13 may be curved or may have an angle, for example, up to 45° from the part parallel to rack 20 to ensure that the sliding of protrusions 15 along slits 16 would result in the formation of a desired angle between surface 11A and 11B.

Angle 20 may be created by using slits 16 as a track to enable slidable movement of protrusions or screws 15 when patch panel elements 11A and 11B angularly move relative to each other. A desired size of angle 20 may be set by fixing screws 15 into a suitable position along slits 16. Brackets 13 may include a snap mechanism or other connecting means to ensure locking or tightening of brackets 13 in a certain predefined angle to each one of elements 11A and 11B which may include a matching hole or another complementary snap mechanism. The length of slits 16, the size of brackets 13 and the angle or curve of brackets 13 may determine the applicable range of angle 20. For example, larger brackets 13 may allow design of longer slits 16 which may allow patch panel elements 11A and 11B to slide further around hinge 12 and to decrease angle 20.

Figure 3:
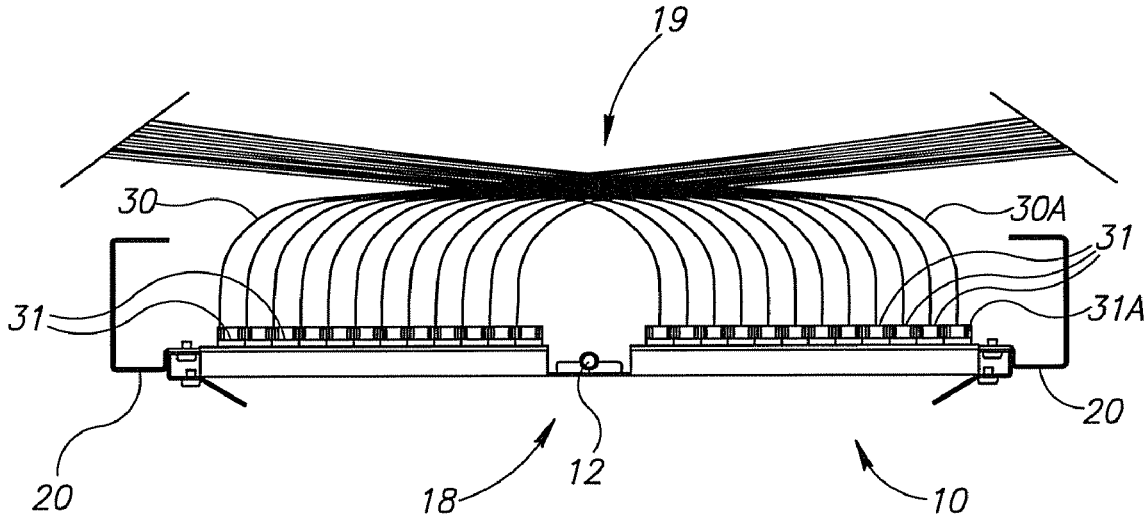
FIG. 3 is a top view of an angled patch panel in a flat position according to embodiments of the present invention.
Figure 4:
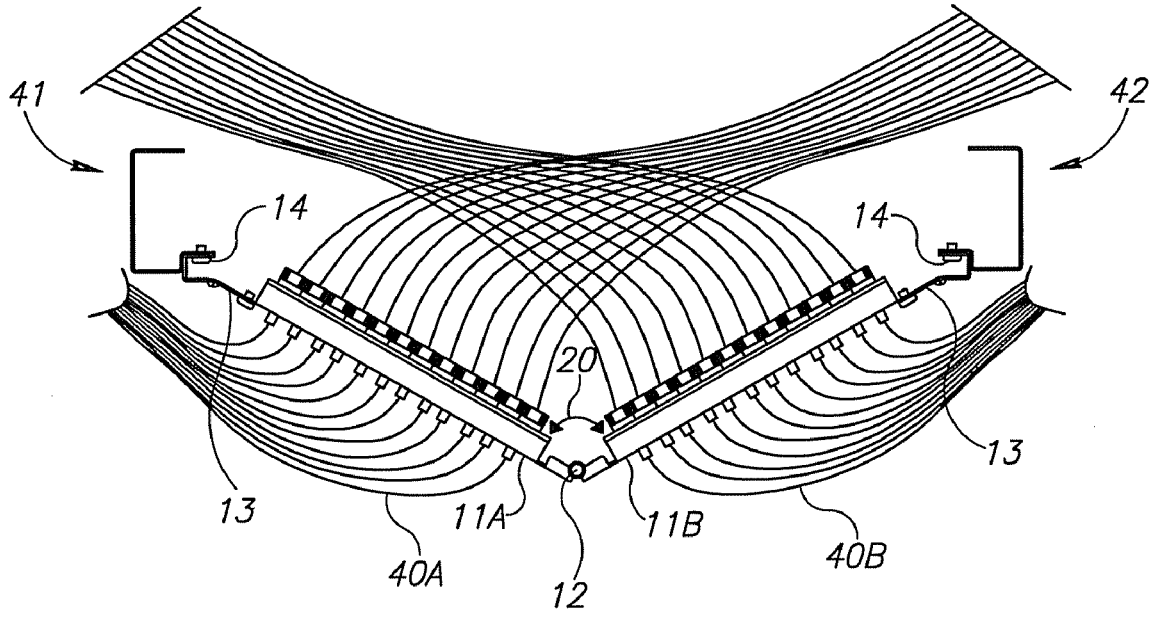
FIG. 4 is a top view of an angled patch panel in an angled position according to embodiments of the present invention.

Reference is now made to FIGS. 3 and 4. FIG. 3 is a top view of an angled patch panel in a flat position according to embodiments of the present invention and FIG. 4 is a top view of an angled patch panel in an angled position according to embodiments of the present invention.

Rear side 19 of path panel 10 may include IDC termination blocks 31 to allow the connection of end-user devices or equipment devices via cables 30 to patch panel 10. Cables 30, also referred to herein as "horizontal cables" may be positioned perpendicularly by connecting each of cables 30 to one of IDC termination blocks 31. For example, as illustrated in FIG. 3, cable 30A is connected to IDC 31A.

The process of inserting horizontal cables 30 into IDC termination blocks 31 at the rear side 19 of a panel 10 may usually require using of a special termination tool. A human installer may use a termination tool to punch down cables 30 into IDC termination blocks 31 by applying force in a direction perpendicular to IDC termination blocks 31. Applying such a perpendicular force in an easy an efficient manner may require positioning patch panel 10 in the flat mode as shown in FIG. 3.

While patch panel 10 is in the flat mode, IDC termination blocks 31 may lie in a line straight. The flat mode of patch panel 10 may provide more space for the installer to terminate horizontal cables 30 resulting in a more efficient process compared to terminating IDC blocks 31 when IDC blocks 31 are not perpendicular to the direction of the installer's punch down action as would be when that patch panel is in the angled mode shown in FIG. 4. For example, when IDC blocks 31 incline relatively to rack elements 20, the installer's work may become more difficult.

When the termination process of horizontal cables 30 to IDC blocks 31 is over, or in any other situation where a flat surface mode may be no longer necessary, the mode of patch panel 10 may be changed from flat mode into angled mode to allow easier management of patch cords on the front side of patch panel 10 as shown in FIG. 4.

Referring to FIG. 4, according to embodiments of the present invention, any desired obtuse angle between 90° to 180° may be formed between surfaces 11A and 11B such that patch cords 40A and 40B may be routed to a different side of rack 20, e.g., cords 40A to the left side 41 at surface 11A and cords 40B to the right side 42 at surface 11B. Vertical management accessories may be used at the both sides of rack 20 to bundle and route patch cords 40A and 40B to their destinations. The split into two groups of patch cords 40A and 40B may enable easier access to patch panel ports 17 and patch cords 40A and 40B.

Moreover, angle 20 formed between elements 11A and 11B may provide an increased space on the rear side 19 of patch panel 10 for housing and accommodating the cabling. Such an increased area may allow the dense environment of cords 30 to be spaced, e.g., the spaces between cords 30 are larger in angled surface mode (FIG. 4) than in flat surface mode (FIG. 3) and thus angle mode may allow easier access to cords 30 and comfortable arrangement of rear side 19 of patch panel 10.

In the exemplary illustration of FIGS. 2 and 4 for simplicity, a certain angle 20 is illustrated, however, it should be understood to a person skilled in the art that any desired angle ranging between 90° to 180° may be applied between front surfaces 11A and 11B.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

What is claimed is:

1. A patch panel mountable on a communication rack having first and second vertical sides, the patch panel comprising:

first and second patch panel elements, wherein both the first and the second elements include communication ports and the first patch panel element is connectable to the first vertical side of the communication rack and the second patch panel element is connectable to the second vertical side of the communication rack;

a hinge connected to both the first and second patch panel elements such that when the patch panel is connected to the communication rack, the hinge is substantially parallel to the vertical sides of the communication rack and angular movement of the patch panel elements relative to each other is enabled; and first and second connecting elements mountable on the vertical sides of the communication rack, each connecting element connected to a respective one of said first and second patch panel elements so as to enable the annular movement of the patch panel elements.

2. The patch panel of claim 1, wherein the first and second connecting elements are first and second brackets.

3. The patch panel of claim 2, wherein each of said first and second brackets includes a slit.

4. The patch panel of claim 3, wherein the slit is used as a track to enable slidable movement of a protrusion extending from one of said patch panel elements when said patch panel elements angularly move relative to each other.

5. The patch panel of claim 3, wherein each of said patch panel elements comprises a screw inserted into said slit to tight each of said brackets to said patch panel.

6. The patch panel of claim 1, wherein said hinge enable positioning of said first and said second patch panel elements with respect to each other at an angle ranging between 90° to 180°.

7. The patch panel of claim 2, wherein each of said first and second brackets comprises a snap mechanism to lock the bracket to the respective patch panel element in a certain predefined angle.

8. The patch panel of claim 1, comprising a securing element to secure an angle of 180° between said first and second patch panel elements.

9. A method for managing a patch panel mountable on a communication rack having first and second vertical sides, the method comprising:

terminating a cable to the rear side of said patch panel when a first and a second patch panel elements are forming an angle of 180°; and changing the angle between said first and said second patch panel elements by an angular movement of said first and second patch panel elements around a hinge positioned substantially parallel to the vertical sides of the communication rack, wherein both the first and the second elements include communication ports and the first patch panel element is connectable to the first vertical side of the communication rack and the second patch panel element is connectable to the second vertical side of the communication rack, wherein changing the angle between said first and second patch panel elements is enabled by first and second connecting elements mounted on the vertical sides of the communication rack, each connected to a respective one of said first and second patch panel elements.

10. The method of claim 9, wherein the first and second connecting elements are first and second brackets.

11. The method of claim 9, wherein changing the angle between said first and second patch panel elements is enabled by a slit used as a track to enable slidable movement of a protrusion extending from one of said patch panel elements when said patch panel elements angularly move relative to each other.

12. The method of claim 10, wherein changing the angle between said first and second patch panel elements comprises tightening each of said brackets to said patch panel by a screw inserted into said slit.

13. The method of claim 9, wherein changing the angle between said first and second patch panel elements comprises positioning of the first and the second patch panel elements with respect to each other at an angle ranging between 90° to 180°.

14. The method of claim 10, wherein changing the angle between said first and second patch panel elements comprises using a snap mechanism to lock each of said first and second brackets to a respective one of said first and second patch panel elements in a certain predefined angle.

15. The method of claim 9, wherein terminating the cable to the rear side of said patch panel comprises securing an angle of 180° between said first and said second patch panel elements by a securing element.

* * * * *